United States Patent [19]

Huddle

[11] 4,148,332

[45] Apr. 10, 1979

[54] DOMED MEMBRANE STRUCTURE AND METHOD OF ERECTING IT

[76] Inventor: Carl F. Huddle, 3 Kenberton Rd., Pleasant Ridge, Mich. 48069

[21] Appl. No.: 815,650

[22] Filed: Jul. 14, 1977

Related U.S. Application Data

[63] Continuation-in-part of Ser. No. 576,101, Jun. 12, 1975, Pat. No. 4,036,244, which is a continuation-in-part of Ser. No. 399,333, May 8, 1973, abandoned, which is a continuation-in-part of Ser. No. 93,293, Nov. 27, 1970, abandoned.

[51] Int. Cl.[2] ..... A45F 1/16

[52] U.S. Cl. ..... 135/4 R; 52/745; 135/14 V; 135/15 PE; 135/15 CF; 135/DIG. 1; 135/DIG. 12

[58] Field of Search ..... 135/1 R, 4 R, 15 CF, 135/14 V, 27, 20 R, 2, DIG. 1; 52/745

[56] References Cited

U.S. PATENT DOCUMENTS

| | | | |
|---|---|---|---|
| 554,792 | 2/1896 | Pittenger et al. | 135/2 |
| 1,428,343 | 9/1922 | Runcie | 135/14 V |
| 2,225,972 | 12/1940 | Brogren | 135/DIG. 1 X |
| 2,465,140 | 3/1949 | Vila | 135/20 R X |
| 2,522,645 | 9/1950 | Senna | 135/27 |
| 2,948,287 | 8/1960 | Rupert | 135/1 R X |
| 2,953,145 | 9/1960 | Moss et al. | 135/1 R X |
| 2,969,075 | 1/1961 | Girten | 135/DIG. 1 X |
| 3,054,413 | 9/1962 | Eshelman | 135/4 R |
| 3,121,439 | 2/1964 | Moltchan | 135/4 R X |
| 3,820,553 | 6/1974 | Huddle | 135/DIG. 1 X |
| 3,953,955 | 5/1976 | Huddle | 135/4 R X |
| 3,958,588 | 5/1976 | Huddle | 52/745 |
| 3,990,194 | 11/1976 | Huddle | 52/80 |
| 4,028,861 | 6/1977 | Huddle | 135/4 R X |

*Primary Examiner*—Price C. Faw, Jr.
*Assistant Examiner*—Conrad L. Berman

[57] ABSTRACT

A membrane structure having a frame constructed of radial supports that extend outward and downward from a common apex to the base. These support members are usually curved semi-arches or have a curved bight, are indirectly attached to each other at the apex and are normally secured directly to the base to oppose outward thrust of the lower ends and to anchor the structure. Outward thrust can also be opposed by an auxiliary circumferential tension member near the base. These supports can be precurved before erection or formed by "bowling" straight members during assembly and/or erection.

The membrane cover supported by the frame is fabricated to curve inwardly between, at least, the curved bights of the supports to decrease membrane vibration, enable it to carry heavy external loads, oppose deflection of the supports and thus add stability to the structure.

Strong membranes having deep inward curvature between curved semiarch bights act as structural members to oppose semi-arch deflection and buckling permitting the use of semi-arches with lesser strength which can reduce semi-arch size, weight, cross-section and cost. For some applications flexability can be safely increased to better absorb uneven wind forces.

One erection procedure includes the folding of precurved supports into parallel planes in a prone position, lifting them to a vertical position, unfolding the supports to their erected position and erecting additional supports, if any. The membrane can be attached to the supports before they are lifted or after the frame is erected.

Another erection procedure includes attaching non-curved support members to an apex assembly, lifting the assembly progressively as the support members are "bowed" to a configuration desired, the membrane installed and the structure secured to the base with or without a circumferential tension member at the base. The membrane can be tensioned by pulling it downward over the arches in an "over-bowed" state, by moving arches apart and/or outward. In some cases, an adjustable section between supports may be required.

38 Claims, 28 Drawing Figures

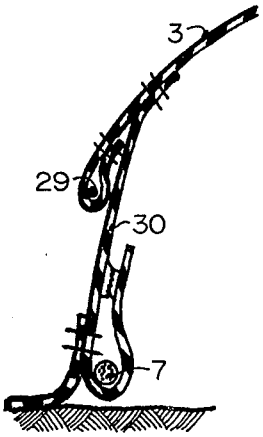
Fig. 20
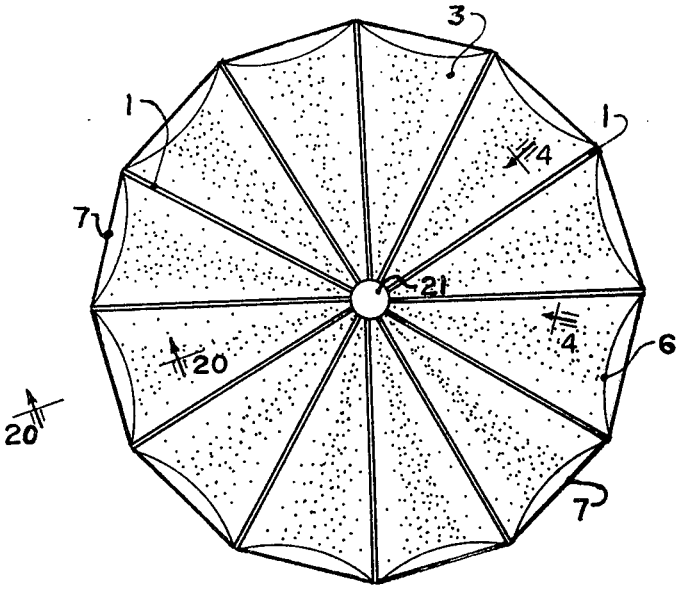
Fig. 2
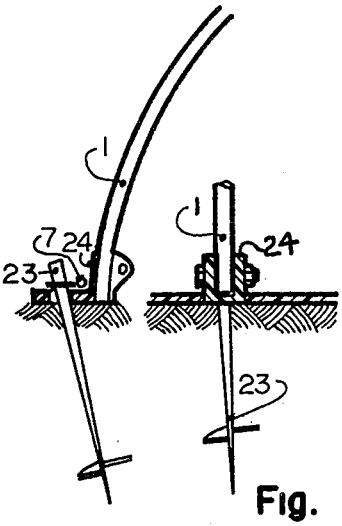
Fig. 13
Fig. 13a
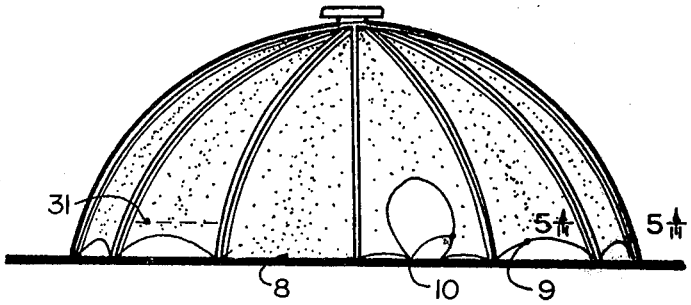
Fig. 3
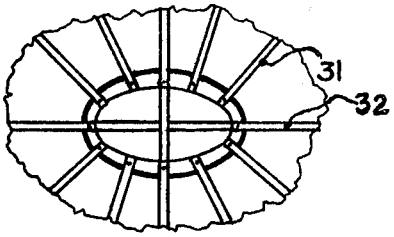
Fig. 24
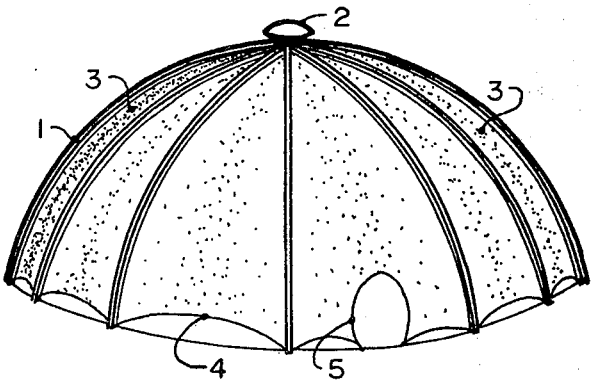
Fig. 1

DOMED MEMBRANE STRUCTURE AND METHOD OF ERECTING IT

BACKGROND OF INVENTION

This is a "Continuation-in-Part" of my application Ser. No. 576,101, now known as U.S. Pat. No. 4,036,244, entitled, "Vertical Arch Shelter", filed June 12, 1975, which is a Continuation-in-Part of my application Ser. No. 399,333, filed May 8, 1973, now abandoned, which was a Continuation-in-Part of the parent application Ser. No. 93293 filed Nov. 27, 1970, now abandoned.

This invention was conceived while working with arch supported membrane shelters having both inclined and/or vertical arches as described in the above applications and such patents of mine as U.S. Pat. Nos. 3,215,153, 3,338,711, 3,802,450, 3,909,993, 3,958,588, 3,961,638, 3,990,194 and others, all of which have arch supported membranes in double curvature to enable the membranes to carry heavy external loads which decreasing membrane vibration and, at the same time, increasing the shelter stability by opposing arch deflection.

While the structures described and illustrated herein have inherent features of my other patents listed here, new shapes, new combinations of components along with new methods of assembly and erection are included in this application that are not apparent in the prior patents.

SUMMARY OF INVENTION

The principal object of this invention is to provide a domed membrane structure that uses lightweight arches and/or semi-arches, that are stabilized by tensioning the membrane in a double curvature configuration thus enabling the structure to carry heavy imposed loads of wind, snow, or ice.

Another object of the invention is to provide a much more economical domed structure by the use of strong membranes that are fabricated to curve sufficiently inward, between curved arches or curved bights of semi-arches, to enable the membrane to "capture" the arch or a section thereof, thus opposing arch deflection and restraining arch movement within the elastic limits of the tensile strength of the membrane.

Another object of this invention is to provide a domed membrane structure in which membrane vibration is greatly decreased or eliminated by a tensioned configuration of the membrane.

Another object of this invention is to provide a domed membrane shelter that has a frame consisting of semi-arches that are "bowed" to the shape desired during erection from straight members to facilitate shipment and handling prior to erection.

Still another object of this invention is to provide easy and simple methods of erection for pre-curved semi-arch members.

Another object of this invention is to provide an erection procedure whereby straight members are "bowed" and securely retained in this configuration after the membrane is tensioned between the "bowed" semi-arches.

Still another object of this invention is to provide a method of tensioning the membrane between the arches by separation of the arches.

BRIEF DESCRIPTION OF THE DRAWINGS

FIG. 1 is a perspective of a typical arch supported domed structure or shelter.

FIG. 2 is the plan view of FIG. 1.

FIG. 3 is a side elevation of FIG. 1.

FIG. 13 illustrates a connection of a semi-arch to a base or to the ground.

FIG. 13*a* is a side view of FIG. 13.

FIG. 20 is a cross-section of a tension ring and membrane attachment.

FIG. 24 schematically illustrates attachment of semi-arches to an apex assembly of an oval shape.

DESCRIPTION OF THE PREFERRED EMBODIMENTS

Figure 22:
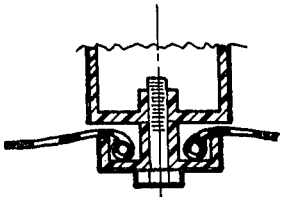
FIG. 22 is a cross-section illustrating one of many methods by which the membrane can be attached to the semi-arches.

In FIG. 1 the assembled structure is shown with semi-arches 1 attached indirectly to each other by means of a circular ring 2 at the apex of the structure. These semi-arches can be regarded as radial supports for the membrane cover 3 which can be attached to the sides or underside of the supports 1 or the membranes 3 can cover the supports 1 like a cap. Various closable or open penetrations can be made in the membrane cover for egress such as illustrated by various tension rings such as shown as 4 or 5. The supports 1 can be arcs or a combination of arcs to form the semi-arches or they may have a combination of straight and arc sections.

FIG. 2 illustrates the radial configuration of the supports 1 from the apex ring 2 that support the membrane 3. The membrane can have a slight inward curvature at the base as shown by 6 to better carry wind loads near the base or snow drifts around the structure. If such loads near the base are negligible, the membrane can be made without the inward curvature 6 to provide more useable space near the base. Also shown in FIG. 2 is a tension ring 7 that prevents the supports from spreading outward. This may be necessary where the semi-arch ends cannot be securely fastened to a concrete slab, firm ground or another dependable sub-base.

FIG. 3 is a side elevation of FIG. 2 which shows the membrane attached directly to the base 8 by use of a member attached to the base or by indirectly by such means as the tension ring member 7 which opposes spreading of the supports 1. The membrane 3 can also be attached to the base by tension rings 9 embodied in the membrane 3 that can be used to urge the membrane downward thus tensioning the membrane vertically and transversely as it is pulled down over the curved supports. Larger openings can be made in the membrane and still keep it tensioned by the use of larger tension rings 10 to provide openings for entrances, exits, or other openings.

Figure 4:
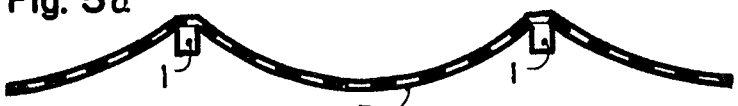
FIG. 4 is a cross-section through the semi-arches and the membrane at about midpoint, taken at line 4—4 of FIG. 1.

FIG. 4 illustrates, in cross-section, the inward curvature of the membrane between supports that enables the membrane to carry heavy external loads of wind, snow or ice and also gives the membrane double curvature between curved sections of the semi-arches. This inward curvature also enables the membrane to "capture" the semi-arches sufficiently to oppose deflection of the semi-arches produced by external loads.

Strong membranes with 10 to 30 times the tensile strength of cotton canvas used in old circus tents, are available today that are woven of fibres such as glass, synthetic organic materials — even inorganic polymers are under development — can be regarded and should be recognized as dependable and safe structural components, at least comparable to the fabric membranes that hold our automobile tires together. When such fabric membranes are used with these structures, they can add to the structural integrity of the structure as a whole, rather than just to support line roof loads such as snow, ice or wind, between the semi-arches. When such strong membranes are given deep inward curvature between curved semi-arches they can "capture" the semi-arch, or at least the curved bight section of the semi-arch, and by its tensile strength oppose deflection or permit limited deflection within the elastic limits of the membrane. The tensioned membrane can control arch flexing depending, of course, on several factors such as the weave of fabric membranes, the angle or steepness of the inward curvature as it sweeps inward away from the arch and, among other factors, the tensile strength of the membrane. With the right choice of such factors, the stability of the semi-arches can be greatly improved and where conditions permit more flexibility of the semi-arches (to flex like aircraft wings under stress) the strength of the semi-arch can be greatly reduced making it possible to reduce the size, weight and cost of the semi-arches as well as related costs of handling, transportation and erection of the structure. The stability inherent with the deep inward membrane curvature design is somewhat comparable with the spokes of a wheel capturing the wheel rim, except that the hub of the wheel would be wider — depending on the membrane sweep angle inward, from the arch, and the depth of the inward curvature.

Even a shallow inward curvature between corresponding bights of adjacent semi-arches will make the membrane shorter in length midway between the arches, from the apex to the base, than its length where it is operatively attached to the semi-arches. As the depth of the inward curvature is increased, the difference in length increases and the effectiveness of the membrane to control arch flexing also increases. The membrane can be fabricated with pockets 11 to partially or intermittently enclose the semi-arches to exactly locate the semi-arches or the membranes can be given sufficient inward curvature to position the arches when the membrane is pulled down over them. In some instances, it may be desirable to employ openable pockets that can be closed by lacing, zippers 11*a*, or other means.

Figure 5A:
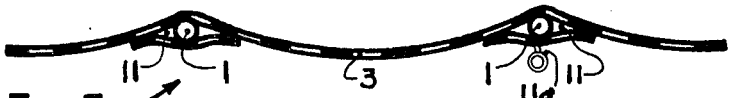
FIG. 5*a* is a cross-section as in FIG. 5 with the addition of illustrating a membrane "pocket" attachment to a semi-arch.
Figure 5:
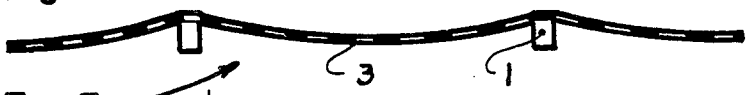
FIG. 5 is another cross-section through the semi-arches and membrane near the base, taken at line 5—5 of FIG. 1.

FIG. 5 illustrates in cross-section, the membrane contour between the arches near the base with very little inward curvature. Reduced inward curvature can also be used near the apex or along the semi-arches when structures are designed for very low external loads or the span between corresponding arch segments is sufficiently short to prevent overloading of the membrane under design loads.

FIG. 5*a* illustrates in cross-section, the membrane near the base as described under FIG. 5 above but with the added "pocket" 11, means to attach the membrane to the semi-arches 1 which can be openable by a means 11*a* such as lacing, zipper, etc.

Figure 6:
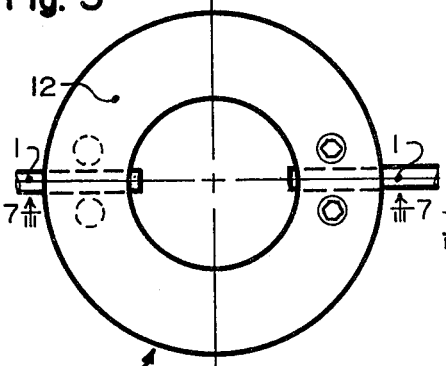
FIG. 6 is an illustration of an attachment of semi-arches at the apex.

FIG. 6 illustrates the use of plates 12 between which semi-arches 1 can be champed by tightening bolts 13.

Figure 7:
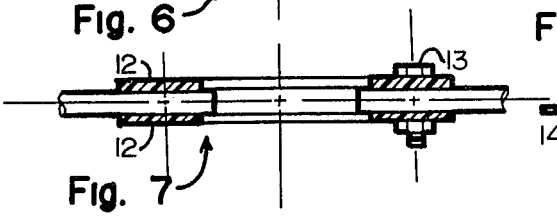
FIG. 7 is a cross-section of FIG. 6, at line 7—7.

FIG. 7 is a cross-section of the clamping plates showing the semi-arches 1 and clamping bolts 13.

Figure 8:
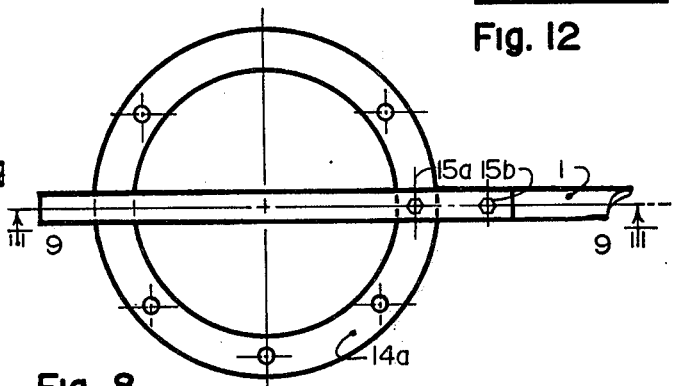
FIG. 8 illustrates attachment of tubular preformed semi-arches at the apex.
Figure 9:
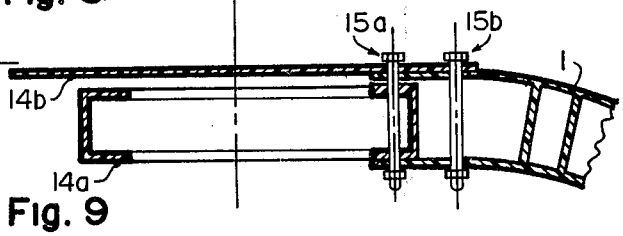
FIG. 9 is a cross-section of illustration FIG. 8, taken at lines 9—9.
Figure 15:
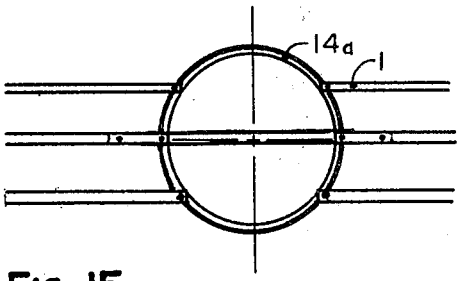
FIG. 15 illustrates how the semi-arches in FIG. 14 fold into a parallel relationship for erection.
Figure 14:
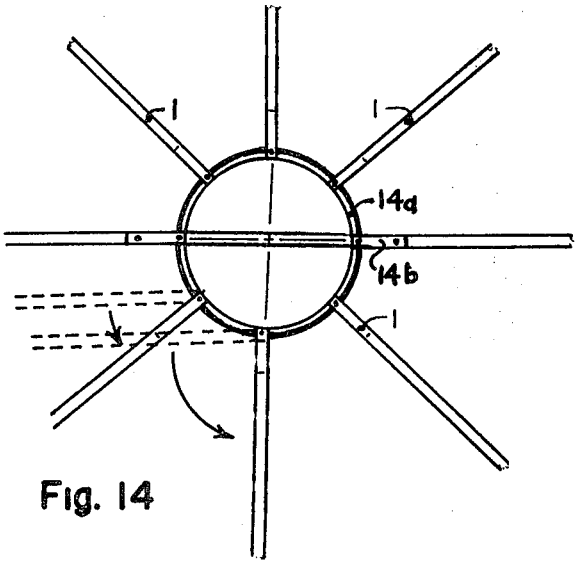
FIG. 14 illustrates connections of pre-formed semi-arches spaced radially at the apex.

FIG. 8 illustrates a channel ring 14*a* used at the apex to indirectly attach the semi-arches 1 to each other in a manner that permits them to pivot around the bolt 15*a* and be locked together by the bolt 15*b*. The locking member 14*b* can be a flat bar to lock two semi-arches together or be a circular plate(s) to lock all semi-arches together rigidly. Pivoting action of the semi-arches is shown in FIG. 9 and FIGS. 14 & 15. These semi-arches can be pre-curved before assembly to the channel ring. A sufficient number of semi-arches can be attached to the channel ring in a prone position on the base because of the pivoting action to erect most of the frame.

Figure 10:
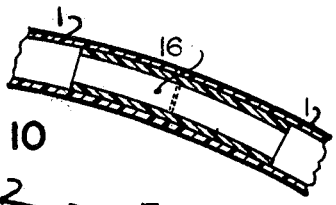
FIG. 10 illustrates a sleeve to interconnect two segments of a semi-arch.

In FIG. 10 a method of assembling semi-arch segments is illustrated. Here a hollow semi-arch can be assembled by using internal sleeves 16 to form a slip joint. The membrane 3 will keep the segments from separating.

Figure 11:
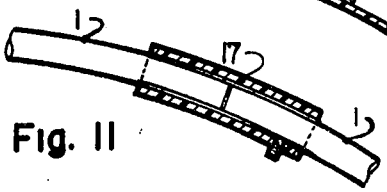
FIG. 11 illustrates an interconnection of rod type segments of a semi-arch.

FIG. 11 illustrates an external sleeve joint 17 between two rod or tube segments 1.

Figure 12:
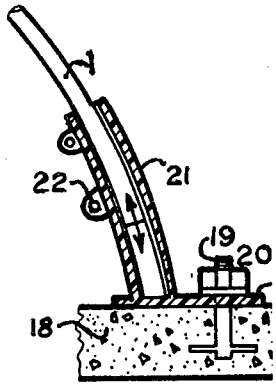
FIG. 12 illustrates an adjustable connection of a semi-arch to a base.

FIG. 12 illustrates how the end of the semi-arches can be attached to a substantial base 18 by such means as an anchor bolt 19 to a radial support or semi-arch foot 20 which is secured to an adjustable means by which the length of the semi-arch can be made by clamping, or other means, to the semi-arch 1. The device illustrated is a split tube 21 with clamping bolts 22. Such an arrangement is usually desirable when the base is not level or to compensate for discrepancies in fabrication of the membrane and/or the semi-arches.

FIG. 13 illustrates a method to indirectly attach the base ends of the semi-arches 1 to the ground by the use of stakes 23 and a means 24 which can be clamped to the semi-arches. FIG. 13 also illustrates the circumferential tension member 7 nested against the means 24 to oppose the outward movement of the semi-arch 1 when the semi-arches are "bowed" from straight segments and/or when an axial load is imposed on the structure.

FIG. 13*a* in cross-section is a side view of FIG. 13 which illustrates one method of anchoring the arch to the base.

FIG. 14 illustrates the radial position of pivotal semi-arches around the channel apex ring 14.

FIG. 15 illustrates how the pivoted semi-arches can be placed in parallel position on the base for lifting to a vertical position to then pivot to the radial position as illustrated in FIG. 14 to form an erected frame.

Figure 16:
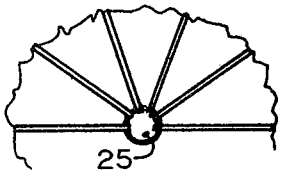
FIG. 16 illustrates a plate connection of arches or semi-arches at the apex.

FIG. 16 illustrates the use of one or more flat plates 25 instead of a circular ring 14 at the apex as a means to indirectly attach the semi-arches to each other. In either case, the semi-arches can be rigidly attached to the plate 25 or to the ring 14 to reduce parts and expense when erection procedure does not require pivotal arches. This is particularly desirable in the erection of small structures, where semi-arches are attached individually to an apex ring, plate or other attachment means as the frame is assembled.

Figure 17:
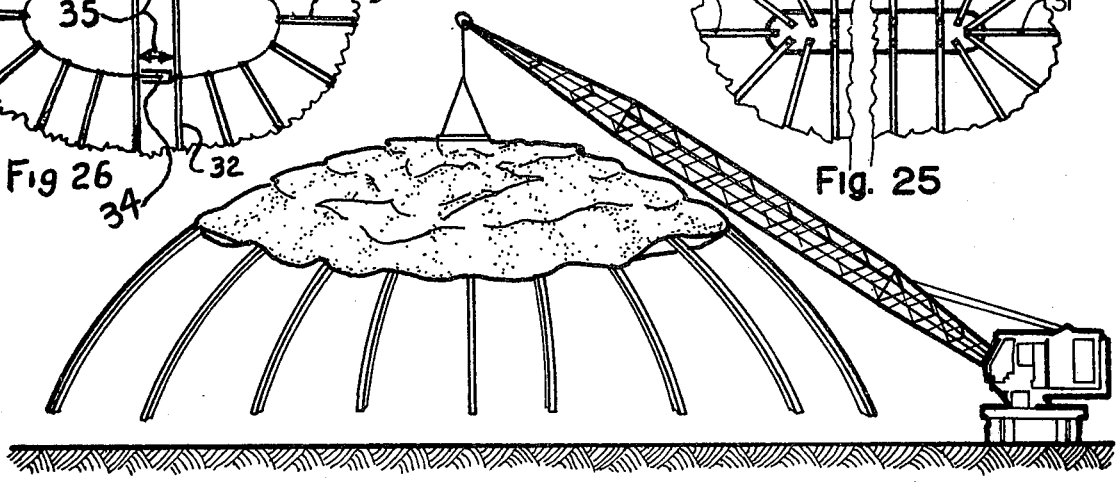
FIG. 17 illustrates the lifting of a multiplicity of semi-arches attached to the apex with the membrane on top of the semi-arches.

FIG. 17 illustrates the lifting of a frame consisting of straight semi-arch members 1 attached to an apex interconnecting ring, plate or other means. These straight sections droop downward toward the base from the apex. The membrane may be placed on the frame near the apex before the frame is lifted.

Figure 18:
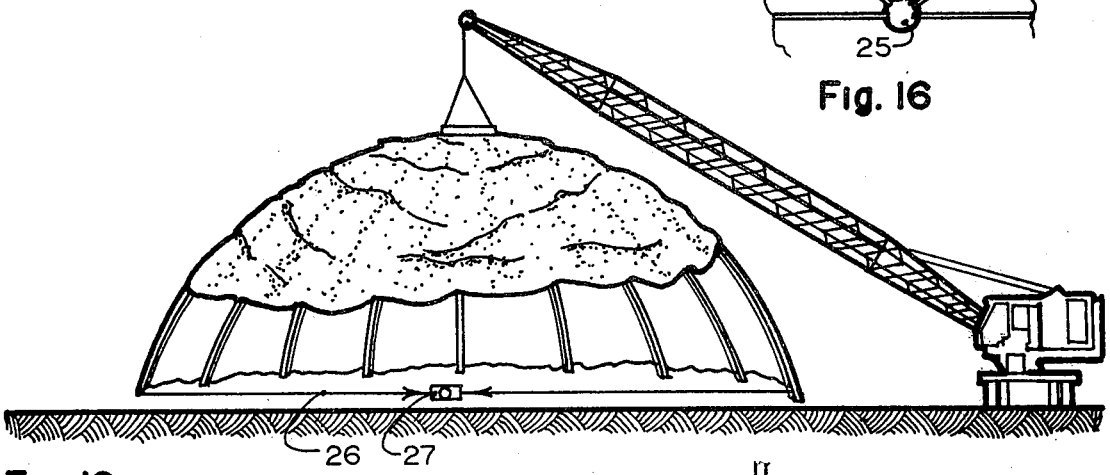
FIG. 18 illustrates "bowing" of the semi-arches during erection.

In FIG. 18 the drooping semi-arch members are pulled inwardly by means of a tension member and a device 27 such as a cable jack. When all of the semi-arches are curved downward and/or inward sufficiently, the semi-arch ends are secured to the base or prevented from moving outward by the circumferential tension member 7. The membrane is then pulled down to tension it over the semi-arches and fixed directly or indirectly to the base by tension rings or otherwise. Variations of procedures to tension or attach the tensioned membrane include "over-bowing" the semi-arches, pulling the membrane downward, fixing it there, then "un-bowing" the semi-arches to help tension the membrane.

Figure 19:
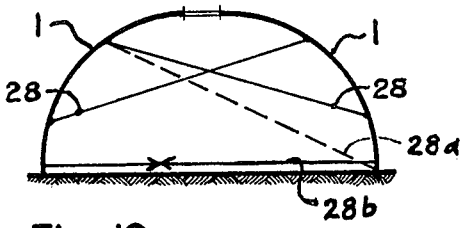
FIG. 19 illustrates anti-sway tension members installed between semi-arches.

FIG. 19 illustrates a method of installing tension members 28 between semi-arches or between semi-arches and the base 28*a* to oppose swaying of the structure under high winds with flexing semi-arches. Trans-structure tension members 28*b* between lower ends of opposite semi-arches may also be desirable.

FIG. 20 is a cross-section to illustrate a tension ring 29 embodied in the membrane 3 between the semi-arches in an arc shaped pocket 9, FIG. 3. The membrane may extend below the tension ring 29 by attaching another section 30 to the membrane 3, or just extending the membrane 3. The lower section 30 can be secured to the tension member 7 by a fastener such as VELCRO so that 30 becomes detachable and can be rolled up to provide an opening under the tension ring 29. Usually the detachable section 30 is secured to the membrane along a straight line as shown by 31, FIG. 3. Zipper, VELCRO or other fastening means can be used to close openings around the sides of 30 or at the base.

Figure 21:
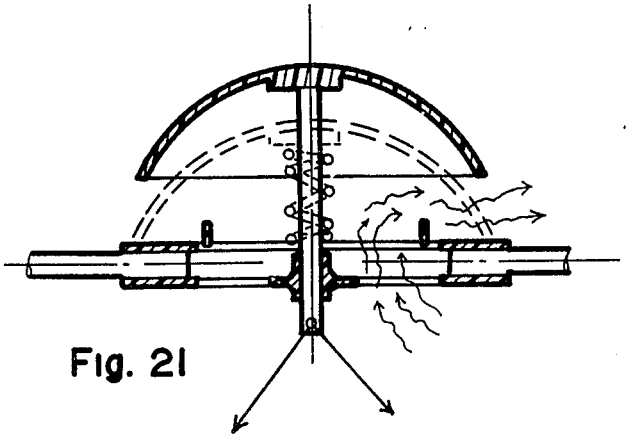
FIG. 21 illustrates a ventilation device in apex of structure.

FIG. 21 illustrates how a ventilating device can be incorporated in the apex ring assembly. This can be manually operated as shown or motor-driven with a remote or automatic control.

Figure 23:
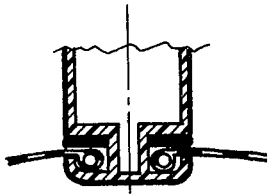
FIG. 23 is a cross-sectional view of another membrane attachment means to the semi-arches.

FIGS. 22 & 23 show other methods of attaching the membrane to the underside (FIG. 21) of the semi-arches or at the side (FIG. 22) of the semi-arches. Such attachments have been illustrated in my other patents in detail.

Figure 25:
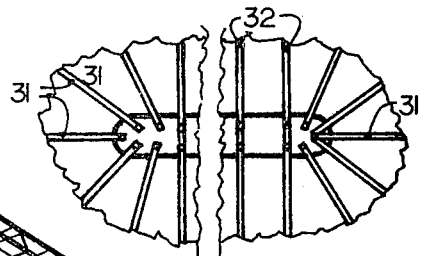
FIG. 25 schematically illustrates the arch attachment configuration of semi-arches and arches to elongated apex assembly plates.

FIGS. 24 & 25 illustrate schematically different shapes of the apex assembly wherein the semi-arches are rigidly fixed or otherwise attached to the apex assembly. Many variations of the shape of an interconnecting plate or ring (even square) are possible within the scope of this application.

FIG. 25 shows schematically a combination of semi-arches 31 and arches 32 fixed to an elongated plate assembly. The arches 32 can also be two semi-arches fixed to the plate, thus requiring only one semi-arch design. Such a combination can also be used in a circular ring assembly as schematically shown in FIG. 8 or an elongated ring assembly can be used that would be similar in shape to this FIG. 25.

Figure 26:
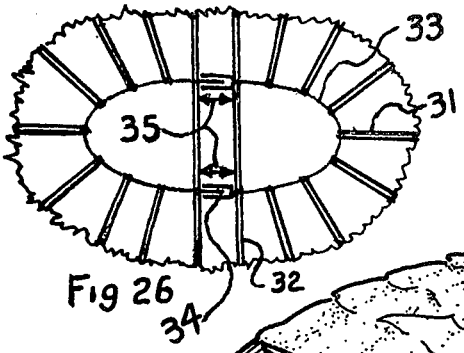
FIG. 26 schematically illustrates how arch separation can tension a domed membrane.

FIG. 26 illustrates schematically how an oval type or elongated ring assembly 33 can be used to separate the center arches or semi-arches 32 to tension a membrane cover that is operatively attached to or supported by the semi-arch frame. Adjustable compression members 35 or jacks can force apart the two telescoping members 34 of the interconnecting means. The amount of movement required depends on the stretch of the membrane and the size of the structures.

I claim:

1. A domed membrane structure comprising a plurality of radial semi-arches forming a frame that includes two adjacent semi-arches with corresponding bights having their lower ends mounted on a base or the ground and their upper ends operatively attached to a means for interconnecting said semi-arches near the apex of the structure; a tensioned roof membrane supported by, extending between and operatively attached to said semi-arches and said base; said membrane having an inward concave curvature between the mid-points of said bights; said membrane having a shorter circumferential length from said apex to said base in a vertical plane midway between said semi-arches, than its circumferential length where it is operatively attached to said semi-arches; means for opposing deflection and flexing of said semi-arches that includes said membrane acting between said inward curvature of said membrane and said bights of said semi-arches, thus permitting the use of more economical semi-arches that can have less strength, decreased weight, smaller cross-section and increased flexibility.

2. The structure described in claim 1 wherein said semi-arches are non-rigid and flex, like aircraft wings, under maximum wind loads within their elastic limits.

3. The structure described in claim 1 wherein said semi-arches are sufficiently flexible to be bowed into arcurate shapes from straight structural members without permanent deformation of the semi-arch material.

4. The structure described in claim 1 wherein said curved bights of said semi-arches are pre-formed prior to erection.

5. The structure described in claim 1 wherein said interconnecting means comprises at least one plate member to which said semi-arches ends are fixed.

6. The combination described in claim 1 wherein said interconnecting means is comprised of a curved ring member to which said semi-arches are operatively attached.

7. The structure described in claim 1 wherein the means to tension at least the lower portion of said membrane includes a tension ring embodied in the lower portion of said membrane comprising a membrane pocket convexly curved upwards above the base that encloses a flexible tension member which is urged downward to tension said membrane which is then secured directly or indirectly to said base to maintain tension in said membrane.

8. The combination described in claim 7 with the addition of said membrane extending below said tension ring with its lower portion being detachable from said base.

9. The structure described in claim 1 wherein said inward curvature of said roof membrane between said semi-arches is tailored with substantial inward sweep, away from said semi-arch bights, to create a pronounced "corrugated effect" thus opposing changes in semi-arch curvature and producing high stability in said structure.

10. The structure described in claim 1 wherein said base is a sub-base such as a wall, a pedestal, a platform or the like.

11. The structure described in claim 1 wherein the lower ends of said semi-arches are mounted on the ground or other base with the addition of a means which fixes the location of each semi-arch lower end.

12. The structure described in claim 11 wherein said means that fixes the location of each semi-arch lower end includes a circumferential member by which said lower ends are indirectly attached to each other.

13. The structure described in claim 12 wherein said roof membrane is indirectly attached to said base by operatively attaching it to said circumferential member between the semi-arch lower ends.

14. The structure described in claim 11 wherein said means which fixes the location of the semi-arch lower ends includes a trans-base tension member.

15. The structure described in claim 11 wherein the means which fixes location of semi-arch lower ends is said roof membrane.

16. The structure described in claim 1 except that said semi-arches are curvilinear in shape.

17. The structure described in claim 1 wherein said semi-arches are adaptable to conform to the tensioned shape of said roof membrane where they are operatively attached.

18. The structure described in claim 1 wherein said semi-arches are adaptable to overbowing during erection for ease of installing said roof membrane.

19. The structure described in claim 1 wherein at least two semi-arches are rigidly connected to each other at their apex to form a continuous arch.

20. The structure described in claim 19 wherein said continuous arch is operatively attached to said interconnecting means.

21. The structure described in claim 1 wherein at least one semi-arch has its upper end pivotably attached to said interconnecting means.

22. The structure described in claim 1 wherein at least one semi-arch is adjustable in length.

23. The structure described in claim 1 wherein the mounting of said semi-arch lower ends on said base includes, in addition, a means to fix said lower ends to the ground or other base by anchor-stakes, anchor-bolts, or the like.

24. The structure described in claim 1 wherein said inward curvature of said roof membrane between said semi-arches is pre-formed during membrane fabrication.

25. The structure described in claim 1 wherein the lower part or the edge of said roof membrane is, in addition, operatively attached directly or indirectly to said base to maintain tension in at least the lower part of said membrane.

26. The structure described in claim 1 wherein said roof membrane, in addition, is operatively attached to said semi-arches by a means permitting downward movement to tension said membrane.

27. The structure described in claim 1 wherein said tensioned state of said membrane is, in addition, created by a means to separate at least two arches or semi-arches at the apex of the structure and by movement apart of the lower ends of said two arches or semi-arches.

28. The structure described in claim 1 wherein the attachment of said roof membrane to said base, in addition, can be indirect and in either case provides a means to anchor said structure to the ground or other base.

29. The structure described in claim 1 wherein in addition said membrane extending between adjacent semi-arches has an inward concave curvature for at least the lower portion of the membrane to enable it to carry live loads of snow, ice, or wind without undue strain.

30. The structure described in claim 1 wherein said semi-arches are substantially rigid and do not noticeably flex to prevent panic during public occupancy or to comply with applicable building codes.

31. The method of erection for a structure described in claim 1 that includes the following steps:

(a) Assembling said semi-arch members and fixing them to said interconnecting means, which will be at the apex of the erected structure,
(b) Placing said membrane cover on said semi-arch members around or near the apex,
(c) Raising said interconnecting means upward until the lower ends of said semi-arches can be moved,
(d) Moving the lower ends of said semi-arches to their erected position,
(e) Pulling said membrane down over said semi-arches and tensioning it to said base.

32. The method described in claim 31 wherein said interconnecting means is raised by "bowing" said semi-arches.

33. The method described in claim 31 except that said membrane is not placed on said semi-arch members in step (b) but is placed over the erected semi-arches after step (d), before step (e).

34. The method described in claim 33 except in step (c) the interconnecting means is raised upward until said semi-arches can be spread radially, by the use of a hinged connection between the upper end of said semi-arches and said interconnecting means.

35. The method described in claim 34 with the addition of semi-arches that are not erected in steps (a), (b), (c) are installed in their erected position after step (d).

36. The method described in claim 31 wherein the moving of the lower ends of said semi-arches to their erected position in step (d) includes "bowing" straight semi-arch members to form semi-arches.

37. The method described in claim 36 except that said semi-arch members are "over bowed" in step (d), then placed in their erected position after the membrane is pulled down over said semi-arches.

38. The method described in claim 36 except that said membrane is not placed on the semi-arches in step (b), until after the arches are placed in their erected position in step (d).

* * * * *